US009854864B2

(12) United States Patent
Hamel et al.

(10) Patent No.: US 9,854,864 B2
(45) Date of Patent: Jan. 2, 2018

(54) BICYCLE HELMET

(71) Applicant: LOUIS GARNEAU SPORTS INC., St-Augustin-de-Desmaures (CA)

(72) Inventors: Dominic Hamel, St-Augustin-de-Desmaures (CA); Louis Garneau, St-Augustin-de-Desmaures (CA)

(73) Assignee: LOUIS GARNEAU SPORTS INC., Quebec (CA)

( * ) Notice: Subject to any disclaimer, the term of this patent is extended or adjusted under 35 U.S.C. 154(b) by 231 days.

(21) Appl. No.: 14/230,690

(22) Filed: Mar. 31, 2014

(65) Prior Publication Data

US 2015/0272254 A1 Oct. 1, 2015

(30) Foreign Application Priority Data

Mar. 28, 2014 (CA) ..... 2847771

(51) Int. Cl.

| | |
|---|---|
| ***A63B 71/10*** | (2006.01) |
| ***A42B 3/04*** | (2006.01) |
| ***A42B 3/28*** | (2006.01) |
| ***A42B 3/12*** | (2006.01) |

(52) U.S. Cl.

CPC ..... *A42B 3/0493* (2013.01); *A42B 3/12* (2013.01); *A42B 3/28* (2013.01); *A42B 3/283* (2013.01)

(58) Field of Classification Search

CPC ..... A42B 3/0493; A42B 3/12; A42B 3/28; A42B 3/283; A42B 3/066; A42B 3/32; A42B 3/322; A42B 3/324; A42B 3/326; A42B 3/328; A42B 3/16; A42B 3/125; A42B 3/127

USPC ..... 2/425, 454, 183, 417, 418, 419, 420

See application file for complete search history.

(56) References Cited

U.S. PATENT DOCUMENTS 4,477,929 A * 10/1984 Mattsson ..... A42B 3/324 2/417
5,438,702 A * 8/1995 Jackson ..... A42B 3/30 2/422
6,154,889 A * 12/2000 Moore, III ..... A42B 3/324 2/411
8,638,969 B2 * 1/2014 Kuhtz ..... H04R 1/1008 381/371

(Continued)

OTHER PUBLICATIONS

Canadian Office Action for corresponding application 2,847,771; dated Jul. 7, 2014.

*Primary Examiner* — Khaled Annis
*Assistant Examiner* — Timothy K Trieu
(74) *Attorney, Agent, or Firm* — Cantor Colburn LLP

(57) ABSTRACT

A helmet has an inner liner having a body of molded protective material. The body forms an inner cavity adapted to be mounted on a wearer's head to cover portions thereof. An outer shell is secured to and covers the inner liner and forms a generally continuous exposed surface of the helmet. A peripheral edge of the outer shell defines a lower contour of the helmet. Slits are defined in the outer shell and project generally upward from the peripheral edge. Flaps are defined each slit and by material of the outer shell deformed to an open position from a tucked position to open the lower contour of the helmet. A mechanism connects each flap to a remainder of the helmet at least in the tucked position.

16 Claims, 6 Drawing Sheets

(56) References Cited

U.S. PATENT DOCUMENTS

| | | | | |
|---|---|---|---|---|
| 2006/0212998 | A1* | 9/2006 | Gath | A42B 3/16 2/423 |
| 2009/0300827 | A1* | 12/2009 | Mizuno | A42B 3/163 2/423 |

* cited by examiner

BICYCLE HELMET

TECHNICAL FIELD

The present application relates to bicycle helmets of the aerodynamic type such as track, triathlon or time-trial helmets.

BACKGROUND OF THE ART

Bicycle helmets with aerodynamic outer shells have been used in disciplines in which reduced drag is an important consideration. For instance, in cycling disciplines such as track, triathlons and time trials, it is desired to reduce the drag caused by the racer. As the rider's head is located at a front of the bicycle when the rider is in a racing stance, headwear may be an important source of drag. Accordingly, bicycle helmets with aerodynamic outer surfaces have been created for such disciplines. In comparison with other bicycle helmets which have a plurality of vent holes, aerodynamic bicycle helmets have fewer ventilation holes in favour of a smoother continuous surface having increased streamline properties. Such aerodynamic bicycle helmets typically cover the ears of the rider, as the ears may be a source of drag.

Among the various factors in designing such helmets, the volume of the helmet may be kept as small as possible, without having an impact on the safety features of the helmet. Moreover, the outer shell of such helmets may often come as close as possible to the head of the wearer, especially at the bottom edge of the outer shell, to conform to the rider's anatomy. As the bottom edge of the outer shell of such helmets is often below the ears to cover same, it may be a challenge to install such a helmet on one's head. Such aerodynamic helmets have been conventionally plastically deformable at the bottom edge to fit one's head through the opening. However, this may result in a gradual deformation of the helmet and hence impact the aerodynamic properties thereof and/or result in painful pressure on the wearer's head.

SUMMARY

It is an aim of the present disclosure to provide a bicycle helmet that addresses issues related to the prior art.

Therefore, in accordance with the present disclosure, there is provided a helmet comprising: an inner liner having a body of molded protective material, the body forming an inner cavity adapted to be mounted on a wearer's head to cover portions thereof; an outer shell secured to and covering the inner liner and forming a generally continuous exposed surface of the helmet, a peripheral edge of the outer shell defining at least part of a lower contour of the helmet; at least one slit defined in the outer shell and projecting generally upward from the peripheral edge; at least one flap defined by the at least one slit and by material of the outer shell deformed to an open position from a tucked position to open the lower contour of the helmet; and a mechanism connecting the at least one flap to a remainder of the helmet at least in the tucked position.

DETAILED DESCRIPTION

Figure 1:
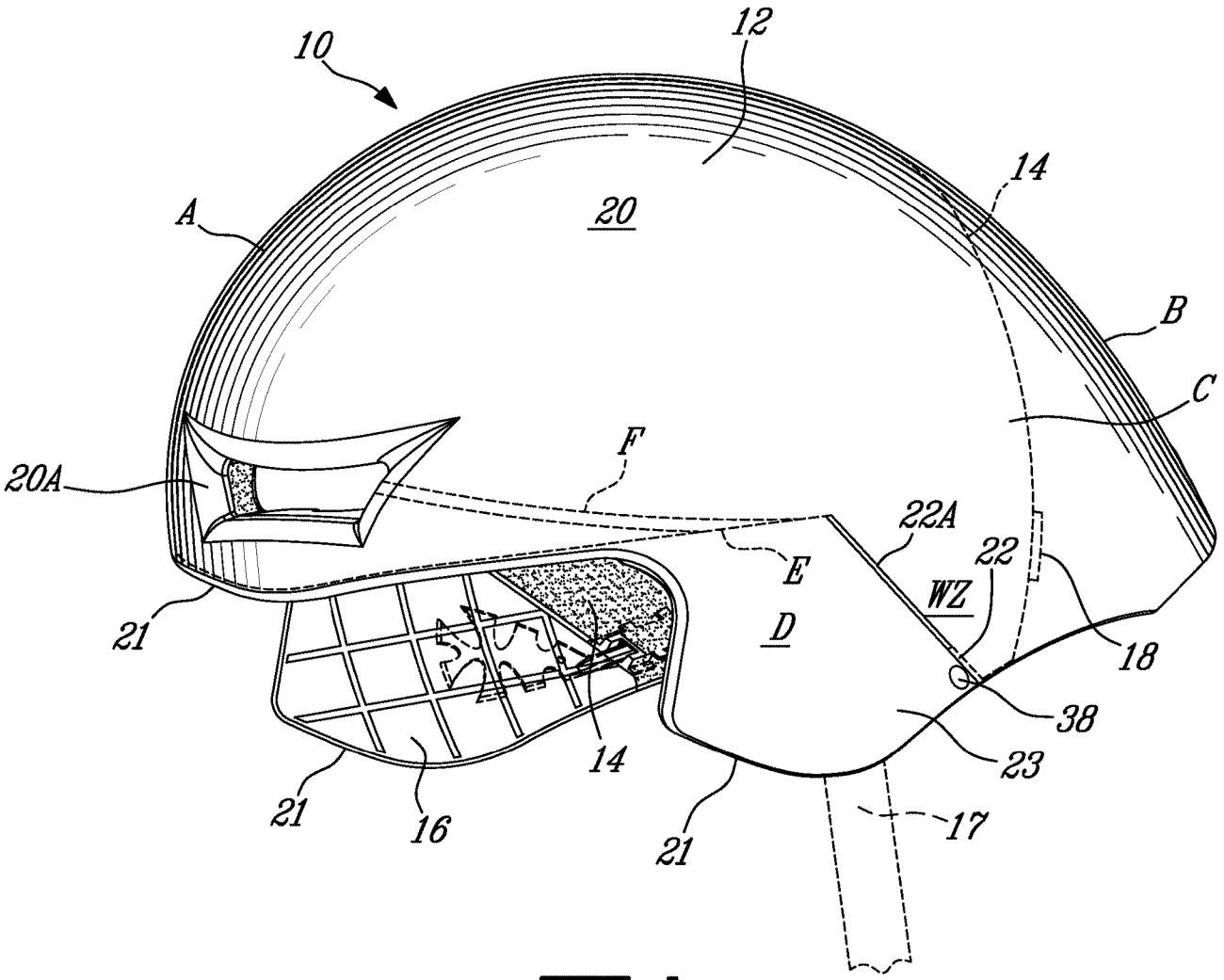
FIG. 1 is a perspective view of a bicycle helmet in accordance with an embodiment of the present disclosure, as worn during use.

Referring to the drawings and more particularly to FIG. 1, there is illustrated a bicycle helmet 10. The bicycle helmet 10 is of an aerodynamic nature, and is typically used in disciplines such as track, time trials and triathlons, although the helmet 10 could be used in other disciplines as well, such as wheelchair racing, skiing, etc.

The helmet 10 has an outer shell 12 in which is located a liner 14. The outer shell 12 and the liner 14 may be co-moulded or assembled after moulding. The outer shell 12 forms the outer surface of the helmet 10, and defines a given aerodynamic shape to reduce the lessen drag of the helmet 10. The outer shell 12 is typically made of a polymeric material such as polycarbonate, polypropylene, etc, and features a front portion A, a tail portion B, and side portions C. The side portions C have ear-covering portions shown as D, which cover the rider's ears. Although the tail portion B is shown as having a tapering end, other configurations are considered as well.

The liner 14 is the main protective body of the helmet 10. The liner 14 is typically made of a foam material, such as expanded polystyrene. Other materials are considered as well, such as expanded polypropylene, expanded polyethylene, polyurethane or any other similar materials. The liner 14 fills a portion of the outer shell 12, with its bottom contour shown as E.

Ear pads 16 (one shown in FIG. 1) may be located inside the outer shell 12, in the ear-covering portions D, below the bottom contour E. The ear pads 16 may be of resilient nature, for instance with a fabric covering a foam material such as open-cell polyurethane, etc. The ear pads 16 will be described in further detail hereinafter. Referring to FIG. 1, the ear pad 16 is shown having generally vertical and generally horizontal channels (generally parallel and/or transverse relative to a slit to be described hereinafter). These channels are defined to lessen the resistance of the ear pad 16 during deformation of the outer shell 12 as described hereinafter. Indeed, such channels are configured to facilitate the deformation of the ear pad 16.

Other components, such as straps 17 and an occipital adjustment mechanism 18 are shown schematically, and are typically provided in the helmet 10. Likewise, a detachable lens may also be part of the helmet 10.

Figure 2:
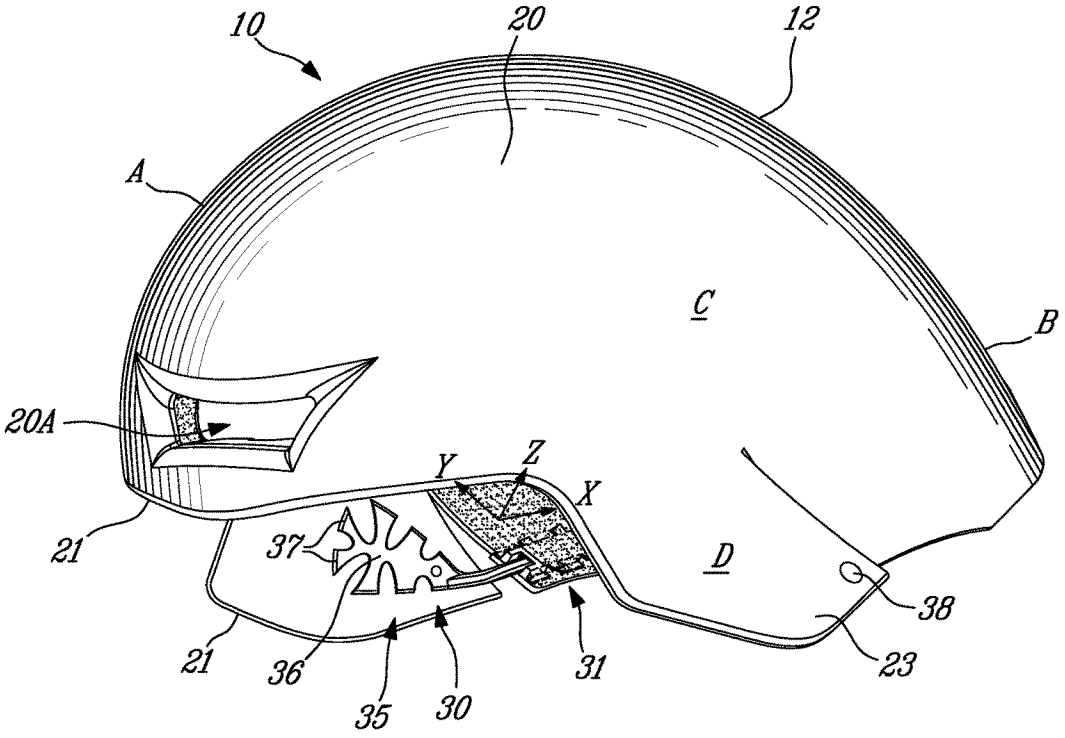
FIG. 2 is a perspective view of the bicycle helmet of FIG. 1, in an open state to be put on a user's head.

Referring to FIGS. 1 and 2, the outer shell 12 is shown having an outer surface 20 that may be referred to as an aerodynamic surface. The outer surface 20 is substantially smooth and continuous (little or few air vents comparatively to standard bicycle helmets), and may or may not comprise vents, such as central vent 20A. Moreover, although the outer surface 20 is shown as being relatively smooth, dimples, deflectors and the like may be provided on the outer surface 20. The outer surface 20 is delimited by a bottom edge 21 which defines the bottom contour of the outer shell 12. Hence, the bottom edge 21 also defines the opening by which a user may insert his/her head in the helmet 10. It is observed that the bottom edge 21 is in some locations below the bottom contour E of the liner 14, while being collinear in some other regions. For instance, the bottom contour E of the liner 14 terminates above the ear-covering regions D of the outer shell 12, whereby there is no liner material in the ear-covering regions D.

As best seen in FIGS. 1 and 2, a slit 22 is formed in the outer shell 12, and projects upwardly from the bottom edge 21 in the side portions C/ear-covering regions D of the helmet 10. Hence, as shown in FIG. 2, an openable flap or wing 23 may be bent outwardly, by elastic deformation of the material of the outer shell 12. The absence of liner material ear-covering regions D allows the elastic reformation of the wing 23. By flipping the wing 23 open in the manner shown in FIG. 2, the bottom contour of the outer shell 12, defined by the bottom edge 21, makes room to facilitate the positioning of the helmet 10 over one's head. In the embodiment of FIGS. 1 and 2, the helmet 10 has a pair of the wings 23. It is however considered to have a single one of the wings 23.

Referring to FIG. 1, it is observed that the slit 22 may widen to form an exhaust vent 22A. The exhaust vent 22A may be part of the slit 22 in that they concurrently define the rear detachment line of the wing 23. In a standard manner, air circulation channels (schematically shown as F in FIG. 1) are defined in the liner 14 and/or in the outer shell 12 in an interior of the helmet 10, which channels F may be in fluid communication between the central vent 20A and the exhaust vent 22A. Accordingly, air entering the central vent 20A may be directed through the helmet via the channels F toward the exhaust vents 22A (one on either side) to then exit the helmet 10. As the exhaust vent 22A is in a narrowing portion of the helmet in a streamline direction, it may be a location at which the relative pressure due to some vacuum effect, i.e., a wake zone WZ of the helmet 10. Hence, air exhausted via the exhaust vents 22A may help entraining air flow around the helmet 10 by lessening the vacuum effect at the location of the exhaust vents 22A.

Figure 3:
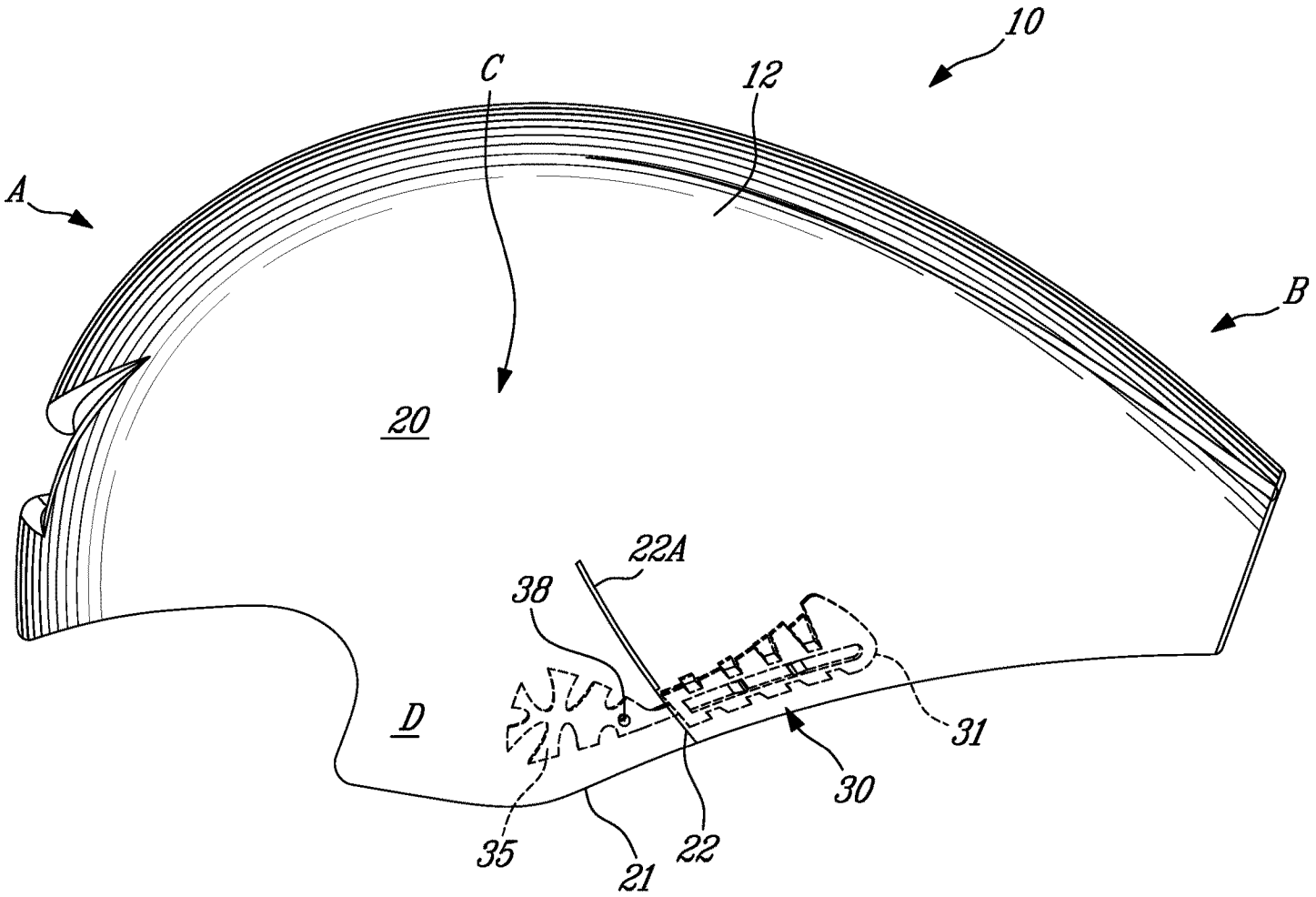
FIG. 3 is a side elevation view of the bicycle helmet of FIG. 1.

The wing 23 may be flipped open by way of elastic deformation of the material of the outer shell 12, but must then be returned to their tucked position of FIG. 1, to reduce drag. A blocking mechanism 30 is provided to guide the wings 23 in returning to the tucked position of FIG. 1, and hence form the continuous low-drag surface. Referring to FIGS. 1 and 3, the blocking mechanism 30 has a casing 31. The casing 31 may be secured to an interior of the outer shell 12, downstream of the slit 22. The casing 31 may be co-molded into the material of the liner 14, and hence held captive between the outer shell 12 and the liner 14.

Figure 4:
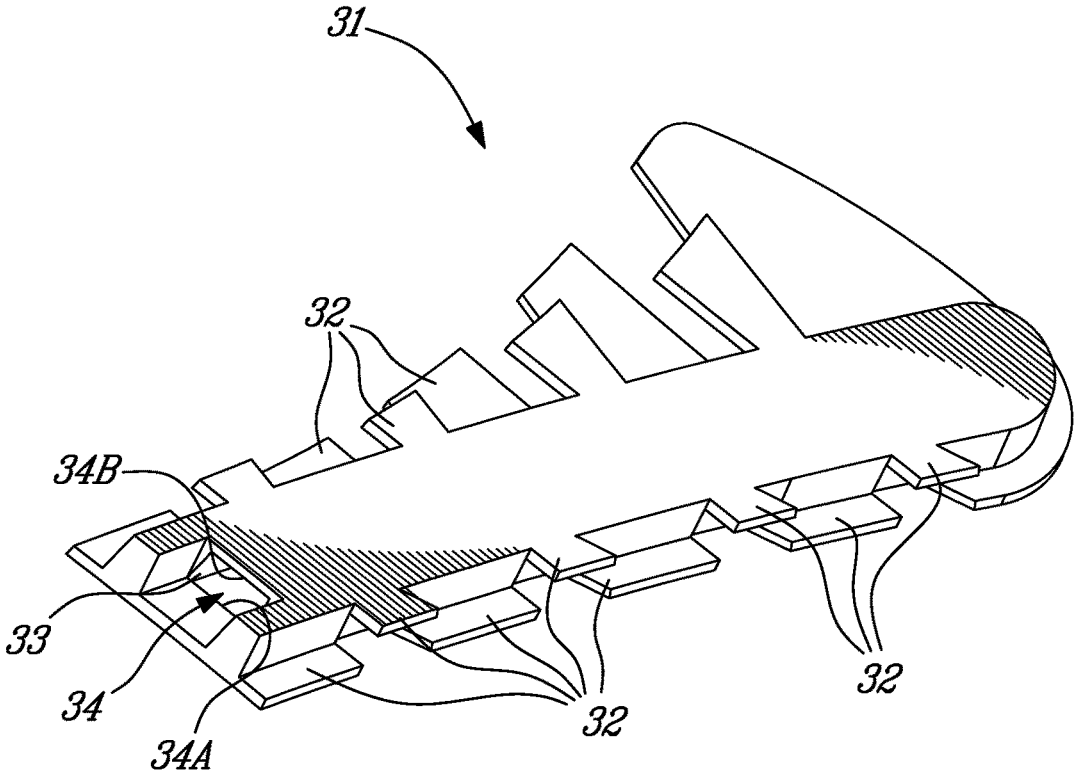
FIG. 4 is a first perspective view of a casing of a blocking mechanism of the helmet of FIG. 1.
Figure 5:
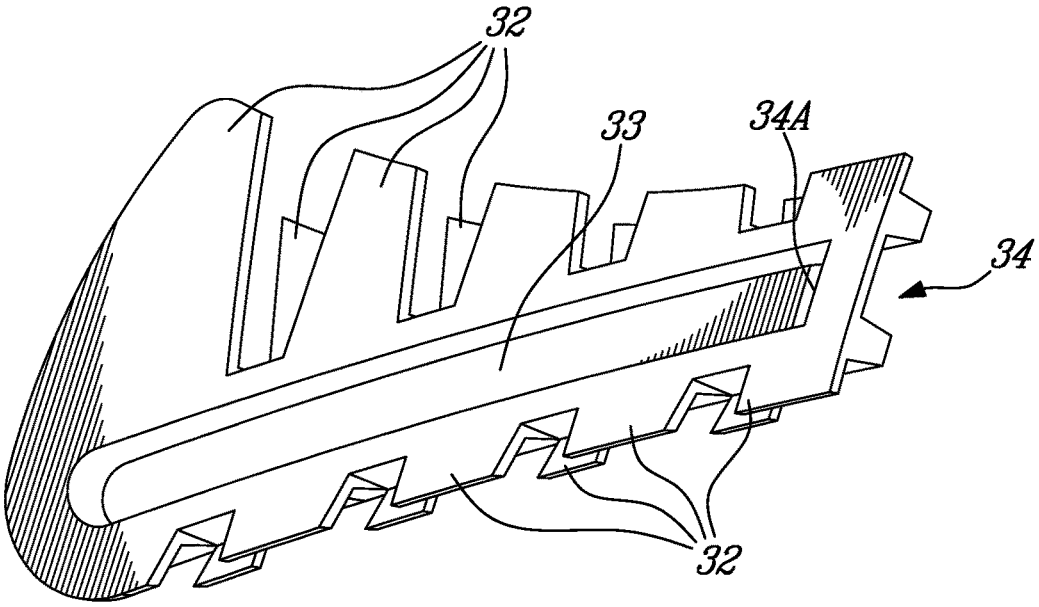
FIG. 5 is a second perspective view of the casing of FIG. 3.

Due to the concave surfaces of the outer shell 12, one configuration considered to secure the casing 31 is by having a plurality of legs 32 as shown in FIG. 4, as an alternative to having a standard polygonal shape (e.g., rectangle). Other configurations are considered as well. The casing 31 has two different levels of legs 32, one of which may be in contact with the inner surface of the outer shell 12 in the manner shown in the figures, the other of which may be embedded into the material of the liner 14 as a result of co-molding. This enhances the bond between the casing 31 and the outer shell 12/liner 14. Moreover, adhesives may be used between the casing 31 and the outer shell 12. Referring to FIGS. 4 and 5, the casing 31 has an elongated slot 33 having an opening 34. An abutment 34A is provided at the opening 34, the use of which will be described hereinafter. A clearance 34B is on the opposite side of the slot 33 and is in line or close to being in line with the slot 33 in the Z axis.

Figure 6:
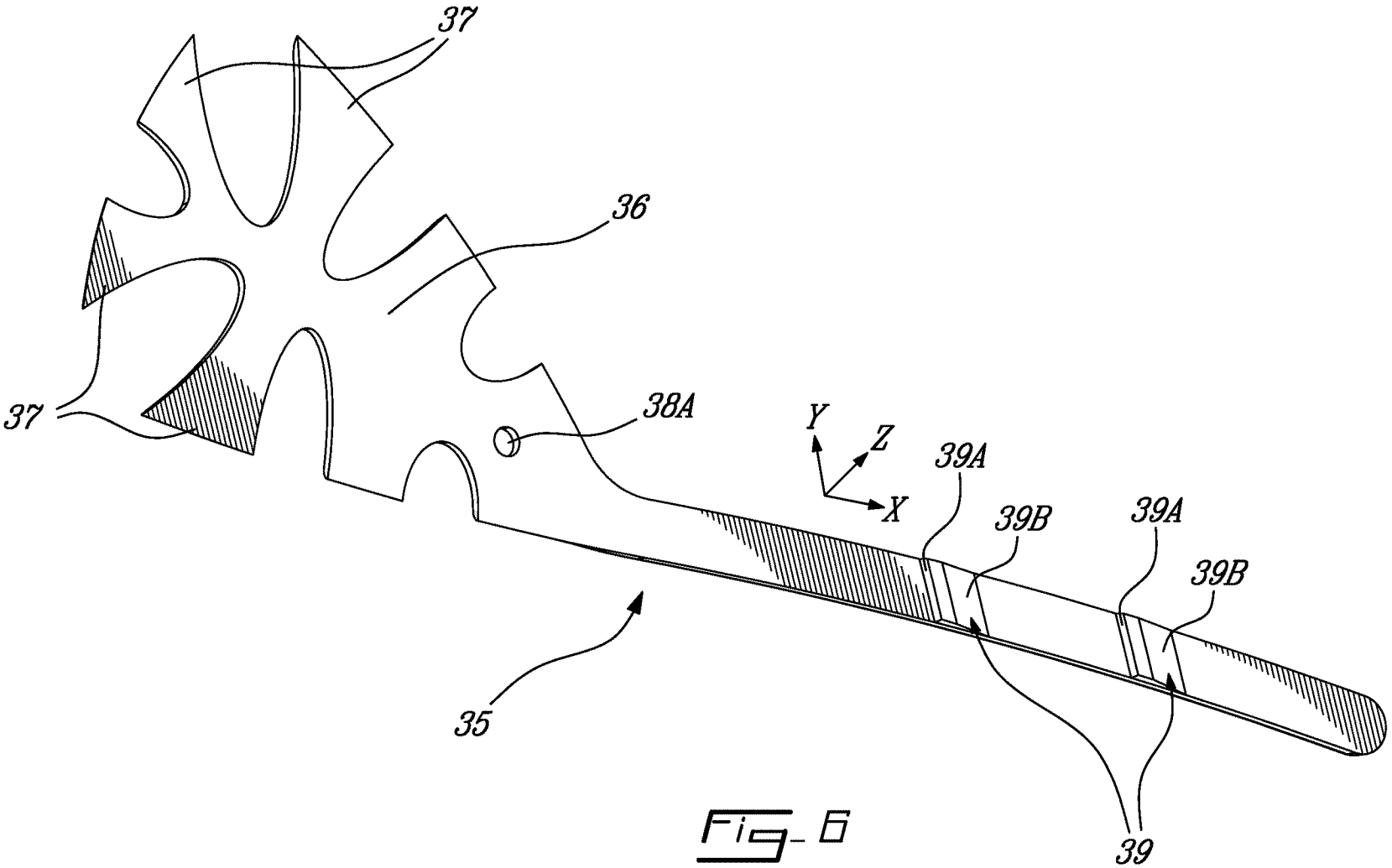
FIG. 6 is a perspective view of a strap of the blocking mechanism of the helmet.
Figure 7:
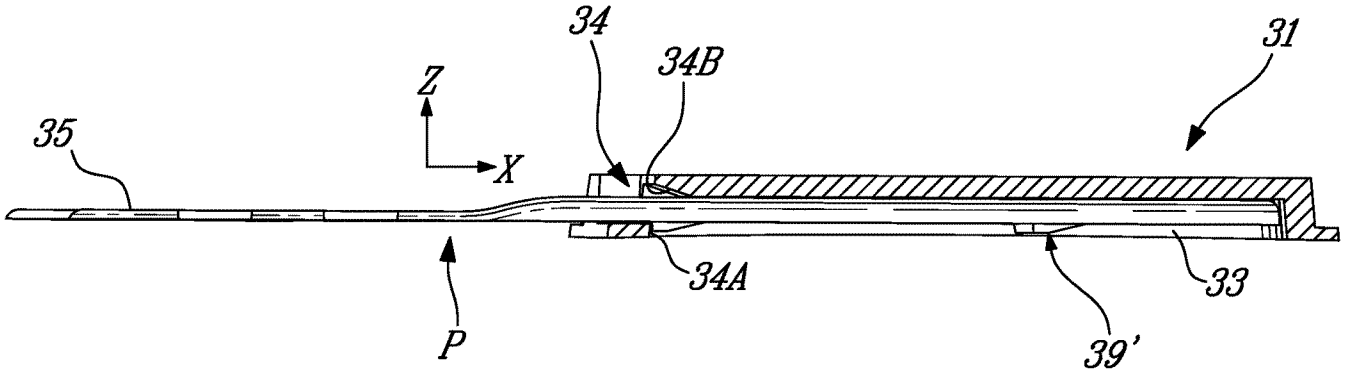
FIG. 7 is a schematic view of an engagement between the strap and the casing in the blocking mechanism.
Figure 8:
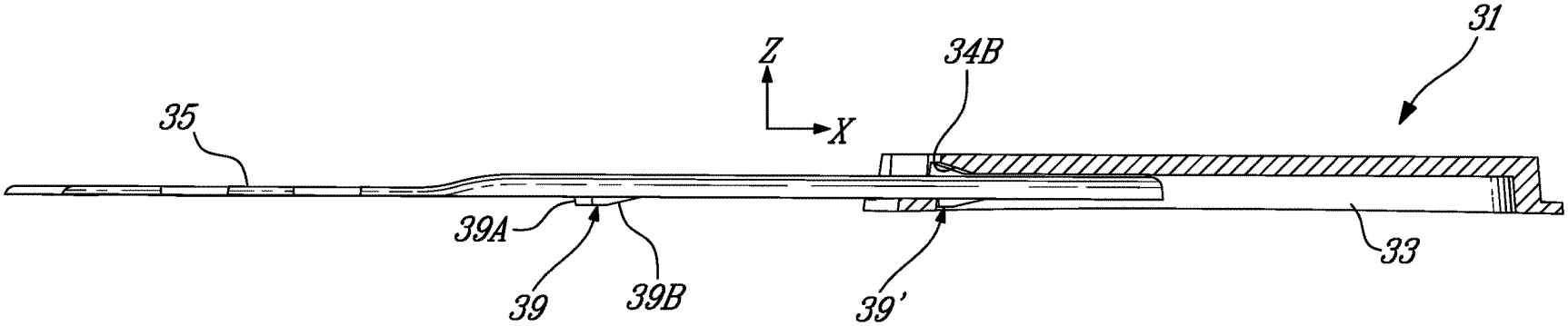
FIG. 8 is a schematic view of an engagement between the strap and the casing in the blocking mechanism, when abutted.

Referring to FIGS. 2 and 6, a strap 35 is illustrated as part of the blocking mechanism 30. The strap 35 may also be referred to as a tape, a strip or the like. The strap 35 has an elongated body portion received in the slot 33 of the casing 31, via the opening 34. The casing 31 and the strap 35 are in a sliding relation, in that the strap 35 may move in its longitudinal direction X as guided by the walls of the slot 33. However, there is little if not no play between the slot 33 and the strap 35 in a direction Y transverse to the longitudinal direction, in a plane of the strap 35. There may be some allowable play between the slot 33 and the strap 35, in a direction Z transverse to the longitudinal direction and normal to a plane of the strap 35, for instance by way of the clearance 34B (FIGS. 7 and 8). This being said, although a generally flat strap 35 has been illustrated, the strap may be cylindrical, or may have any appropriate cross-section, with the slot 33 of the casing 31 having a complementary shape for the sliding relation.

The strap 35 has a base portion 36 at an end thereof. The base portion 36 may have an enlarged shape relative to the elongated portion of the strap 35, as it is through the base portion 36 that the strap 35 is connected to the outer shell 12. In a similar manner to the casing 31, the base portion 36 may have legs 37, for the head portion 36 to be secured to a concave inner surface of the outer shell 12, and hence deform to conform to the concave inner surface. A fastener 38, such as a rivet, bolt and nut, or the like, may be used in conjunction with hole 38A to fix the base portion 36 to the outer shell 12.

Although the illustrated embodiment shows the casing 31 of the blocking mechanism 30 in the rear of the slit 22, and the base portion 36 in front of the slit 22, the opposite connection could also be used, with the casing 31 in the flap 23.

Teeth 39 may be defined on the strap 35. The teeth 39 each have a forwardly oriented abutment edge 39A and a rearwardly oriented slope 39B. Therefore, the teeth 39 cooperate with the abutment 34A at the opening 34 of the slot 33, in the manner shown in FIGS. 7 and 8. FIG. 7 is representative of the engagement of the strap 35 in the casing 31 for a tucked position of the wing 23 (FIG. 1). It is observed that one of the teeth 39 abuts against the abutment 34A, preventing the strap 35 from inadvertently moving out of engagement in the slot 33. However, due to the play provided in the transverse direction Z as described above (in an embodiment, possible because of the clearance 34B), a pressure applied at P may help dislodge the tooth 39 from abutment with the abutment 34A. This then allows the movement of the slot 35 out of the casing 31. This may lead to the open position of FIG. 2, in which the wings 23 are flapped open to facilitate the insertion of a user's head in helmet 10.

Referring to FIG. 8, an additional tooth 39' may be located toward an end of the strap 35, and act as a stopper to prevent further movement in the longitudinal direction X of the strap 35. For this purpose, this second tooth 39' may be greater in size than the first tooth 39. It is however considered to have a single one of these teeth 39 (if any at all) or more than the two shown. The slopes 39B of the teeth 38 facilitate the movement of the strap 35 back into the casing 31, for instance in a movement from the position of FIG. 8 to the position shown in FIG. 7.

The blocking mechanism 30 is one of the numerous possible mechanisms helping in keeping the wing 23 in the tucked position of FIG. 1 However, alternative embodiments are considered, such as a hook and loop system, an elastic band or like resilient means, or other possible options. However, it is desirable to have some form of mechanism bridging the slit 22 while being connected to opposed ends of the slit 22 so as to ensure that the wing 23 remains in the tucked position of FIG. 1.

The invention claimed is:

1. A helmet comprising: an inner liner having a body of molded protective material, the body having a bottom contour configured for peripherally surrounding a top portion of a wearer's head and forming an inner cavity configured to be mounted on the wearer's head to cover and surround the top portion of the wearer's head; an outer shell secured to and covering the inner liner and forming a generally continuous exposed surface of the helmet, a peripheral edge of the outer shell defining at least part of a lower contour of the helmet, the outer shell comprising ear-covering portions extending below the bottom contour of the inner liner to form a liner-free space configured to cover the ears of the wearer;

at least one slit defined in the outer shell and projecting generally upward from the peripheral edge;

at least one flap defined in the ear-covering portions continuous of the outer shell, the at least one flap further defined by the at least one slit, and by material of the outer shell deformable from a tucked position to an open position to open the lower contour of the helmet, the flap being in the liner-free space; and a mechanism extending a cross said slit connecting the at least one flap to a remainder of the helmet at least in the tucked position; wherein said slit disposed on a side of said helmet when is worn and extending below of wearer's ears when is worn.

2. The helmet according to claim 1, wherein comprising two of the flaps, with the flaps covering an ear region of the wearer's head in the tucked position.

3. The helmet according to claim 1, wherein the at least one slit defines an exhaust vent.

4. The helmet according to claim 3, wherein the at least one exhaust vent is located at a portion of the outer shell adapted to be behind the ears of the wearer.

5. The helmet according to claim 4, wherein the at least one exhaust vent is located opposite a wake zone of the outer shell defined by a narrowing portion of the helmet in a streamline direction.

6. The helmet according to claim 3, further comprising an inlet vent in a frontal portion of the outer shell, and further comprising at least one vent channel defined by at least one of the inner liner and the outer shell, the vent channel being in fluid communication with the inlet vent and exhaust vent.

7. The helmet according to claim 6, wherein the inlet vent is centralized in the frontal portion of the outer shell.

8. The helmet according to claim 1, further comprising an ear pad in the liner-free space.

9. The helmet according to claim 8, wherein the ear pad has deformation channels that are at least one of generally transverse and generally parallel to the slit.

10. The helmet according to claim 1, wherein the mechanism comprises, for each set of the slit and the flap, a casing connected to the helmet on one side of the slit, and a strap connected to the helmet on the other side of the slit, the strap being operatively received in a slot of the casing to form a joint.

11. The helmet according to claim 10, wherein the strap is connected to the helmet by an enlarged head thereof having projecting legs.

12. The helmet according to claim 10, wherein the casing has projecting legs for connection to the helmet.

13. The helmet according to claim 10, wherein the casing is comolded into the protective material of the inner liner.

14. The helmet according to claim 10, wherein the strap comprises at least one tooth thereon, and wherein the casing has an abutment in said slot, the tooth contacting the abutment in at least one of the open position and the tucked position of the flap.

15. The helmet according to claim 1, wherein the outer shell is made of polycarbonate.

16. The helmet according to claim 1, wherein the inner liner is made of an expanded polymer.

* * * * *